US005259793A

United States Patent [19]

Yamada et al.

[11] Patent Number: 5,259,793

[45] Date of Patent: Nov. 9, 1993

[54] EDGE CONNECTOR FOR A PRINTED CIRCUIT BOARD

[75] Inventors: Shoji Yamada, Machida; Yoshihisa Yamamoto; Hideyuki Hirata, both of Yokohama, all of Japan

[73] Assignee: Molex Incorporated, Lisle, Ill.

[21] Appl. No.: 933,443

[22] Filed: Aug. 21, 1992

[30] Foreign Application Priority Data

Jun. 4, 1992 [JP] Japan ..... 4-113099

[51] Int. Cl.[5] ..... H01R 13/42

[52] U.S. Cl. ..... 439/637; 439/751

[58] Field of Search ..... 439/630-637, 439/741, 751, 873, 851, 861, 862, 326, 327, 328, 62, 65

[56] References Cited

U.S. PATENT DOCUMENTS

| | | | |
|---|---|---|---|
| 3,732,531 | 5/1973 | Bouley | 339/217 R |
| 4,722,700 | 2/1988 | Kuhn et al. | 439/629 |
| 4,725,250 | 2/1988 | Kuhn et al. | 439/629 |
| 4,946,403 | 8/1990 | Billman et al. | 439/631 |
| 4,960,386 | 10/1990 | Stanevich | 439/326 |
| 4,973,270 | 11/1990 | Billman et al. | 439/630 |
| 4,990,107 | 2/1991 | Fortuna | 439/637 |
| 5,082,459 | 1/1992 | Billman et al. | 439/637 |
| 5,100,337 | 3/1992 | Lee Chao | 439/636 |
| 5,104,324 | 4/1992 | Grabbe et al. | 439/62 |

FOREIGN PATENT DOCUMENTS 0027619 9/1970 Japan ..... 439/637

OTHER PUBLICATIONS

Molex Drawing No. 52399-***0.

*Primary Examiner*—David L. Pirlot

*Attorney, Agent, or Firm*—Charles S. Cohen

[57] ABSTRACT

An edge connector is adapted for use with a printed circuit board having a mating edge and a plurality of contact pads on opposite sides of the board adjacent the edge. The connector includes an elongated dielectric housing having a slot for receiving the mating edge of the printed circuit board. A plurality of terminals are mounted on the housing along the slot. Each terminal includes a pair of side support portions fixed to the housing outside opposite sides of the slot, a cross brace portion extending between the side support portions, a terminating portion projecting below the cross brace portion and a spring contact arm projecting upwardly from the cross brace portion and including a contact portion for engaging one of the contact pads on the printed circuit board. The terminals are oriented in an alternating array along the slot whereby the contact portions alternatingly engage contact pads on opposite sides of the printed circuit board.

16 Claims, 3 Drawing Sheets

11
22a
24
10
32
32
12
22b
18

EDGE CONNECTOR FOR A PRINTED CIRCUIT BOARD

FIELD OF THE INVENTION

This invention generally relates to the art of electrical connectors and, particularly, to a high density edge connector for a printed circuit board.

BACKGROUND OF THE INVENTION

A popular type of electrical connector which is used widely in the electronic industry is called an "edge card" connector. An edge connector is provided for receiving a printed circuit board having a mating edge and a plurality of contact pads adjacent the edge. Such edge connectors have an elongated housing defining an elongated receptacle or slot for receiving the mating edge of the printed circuit board. A plurality of terminals are spaced along one or both sides of the slot for engaging the contact pads adjacent the mating edge of the board. In many applications, such edge connectors are mounted on a second printed circuit board. The mating edge board or card commonly is called the "daughter" board, and the board to which the connector is mounted commonly is called the "mother" board.

One of the problems with edge connectors of the character described above centers around the everincreasing miniaturization of such connectors brought about by the demands for high density electronic circuitry. The terminals of such a connector are mounted in a housing fabricated of dielectric material such as plastic or the like. Not only are the terminals becoming ever-increasingly miniaturized, but the dimensions of the housing are becoming smaller and smaller. The terminals are mounted in rows along the slot of the housing, with the terminals being separated by a dielectric partition integral with the housing, and the housing includes side walls for surrounding the terminals. The parameters of providing a very high density connector, in combination with the increasing miniaturization of the connectors, results in the housing portions between and around the terminals becoming extremely thin. Not only does this result in the housing portions potentially providing insufficient support for the terminals, but the stresses placed on the terminals due to their engagement with an inserted circuit board may result in the housing becoming warped, bent, or otherwise disfigured.

This invention is directed to solving the above problems by providing a combination of a particular terminal configuration along with its mounting orientation and support provided by surrounding portions of the housing to provide a sturdy and reliable edge connector capable of high density applications in miniaturized or compact environments.

SUMMARY OF THE INVENTION

An object, therefore, of the invention is to provide a new and improved edge connector for a printed circuit board.

In particular, the invention is directed to applications wherein the printed circuit board has a mating edge and a plurality of contact pads on opposite sides of the board adjacent the edge.

In the exemplary embodiment of the invention, the edge connector includes an elongated dielectric housing having a board-receiving slot means for receiving the mating edge of the printed circuit board. A plurality of terminals are mounted on the housing. Each terminal includes a pair of side support portions fixed to the housing outside opposite sides of the slot means. A cross brace portion extends between the side support portions. A terminating portion projects below the cross brace portion for rigid securement to a complementary circuit component such as a mother board. A spring contact portion projects upwardly from the cross brace portion for engaging one of the contact pads on the printed circuit board.

The invention contemplates that the above configuration of the terminals be employed in the connector in such a manner as to be oriented in an alternating array along the slot means of the elongated housing, whereby the contact portions of the terminals alternatingly engage contact pads on opposite sides of the printed circuit board. It is contemplated that the housing includes a portion supportingly engaging the top side of the cross brace portion at a location positioned on the opposite side of the spring contact portion relative to the card slot to resist rotational movement of the terminal as an inserted printed circuit board biases the spring contact portion thereof transversely of the slot means.

As disclosed herein, the side support portions of each terminal comprise legs projecting upwardly from the cross brace portion near opposite ends thereof, the legs being fixed within holes in the housing outside the slot means. The terminating portion is provided in the form of a solder tail projecting from the cross brace portion below a bottom surface of the housing. The spring contact portion extends upwardly from the cross brace portion generally at a point intermediate the ends thereof. The spring contact portion includes a board contact area offset to one side of the slot means for engaging the contact pad on the one side of the printed circuit board, whereby the board can be located generally centrally of the housing. The housing includes a portion for abutment against the opposite side of the printed circuit board.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
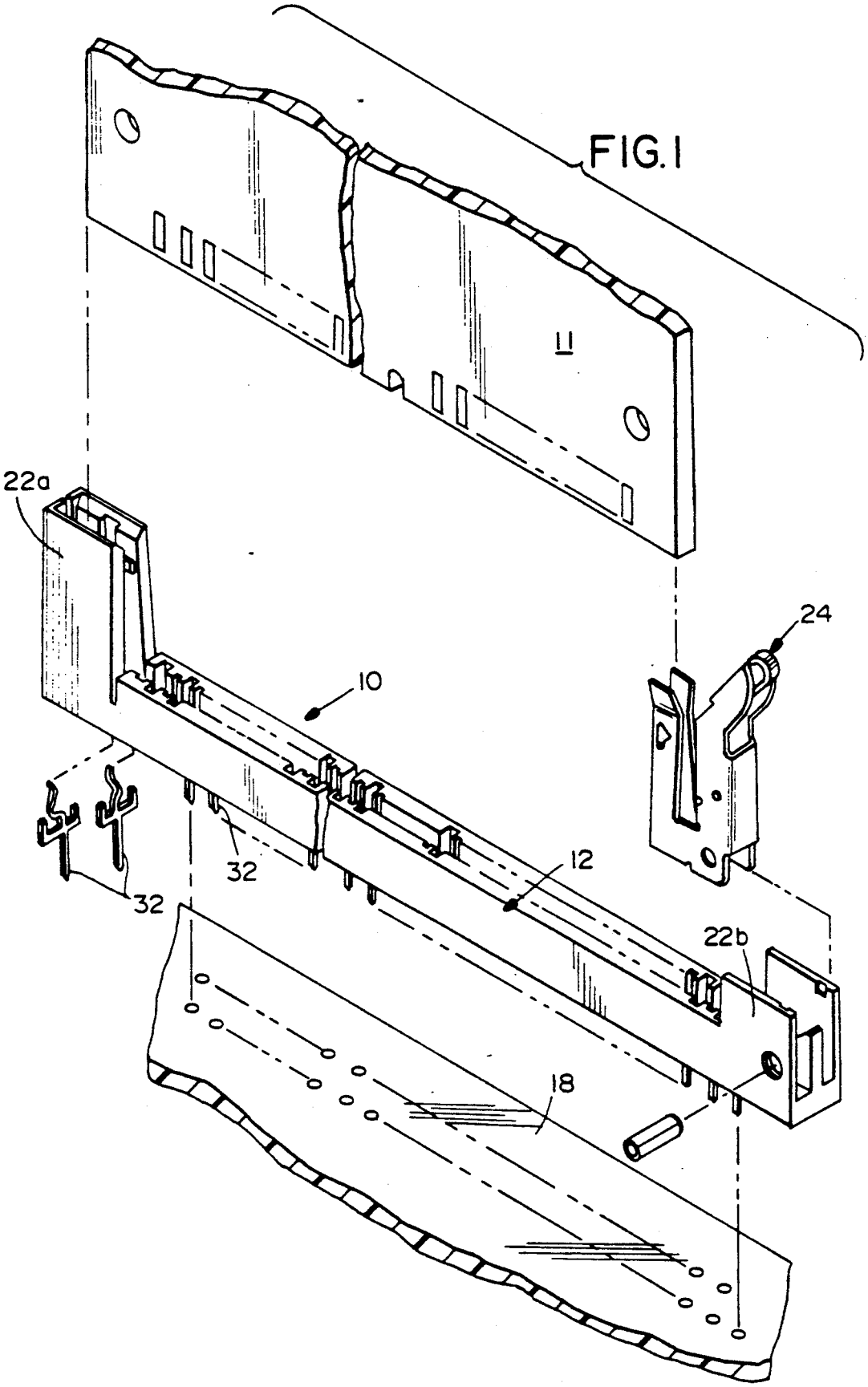
FIG. 1 is an exploded perspective view of an edge connector embodying the concepts of the invention.
Figure 2:
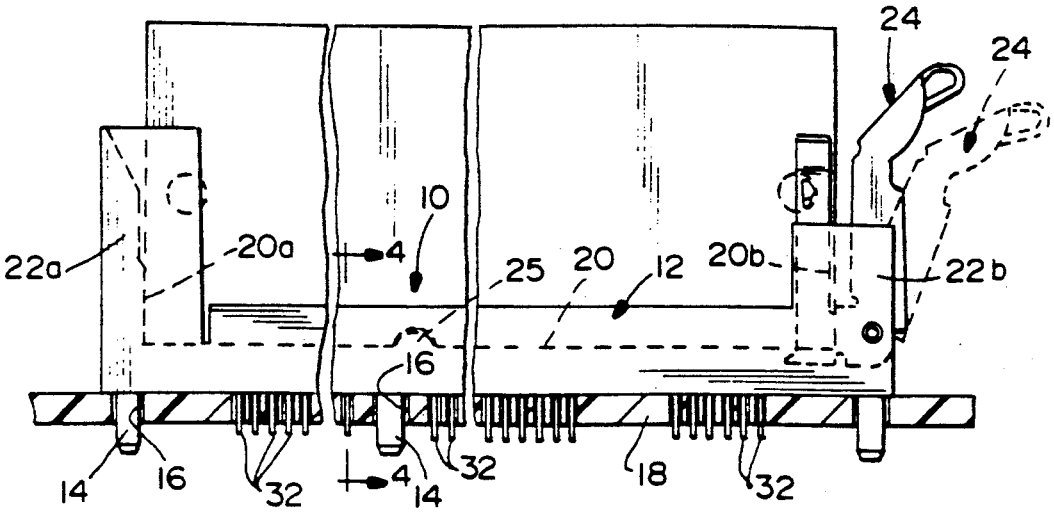
FIG. 2 is a side elevational view of the edge connector of FIG. 1.
Figure 3:
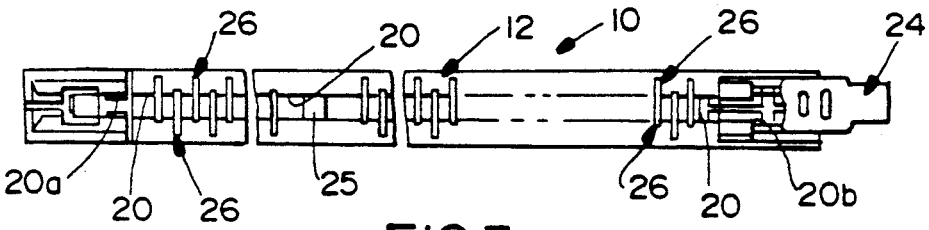
FIG. 3 is a top plan view of the edge connector of FIG. 1.

Referring to the drawings in greater detail, and first to FIGS. 1-3, an edge connector, generally designated 10, is shown for use with a printed circuit board 11. As is conventional with edge connectors, the printed circuit board has a mating edge 11*a* and a plurality of contact pads 42 adjacent the edge. With edge connector 10 of this invention, printed circuit board 11 will have a mating edge and a plurality of contact pads on both sides of the board adjacent the edge. This printed circuit board commonly is called the "daughter" board. In the present configuration, the contact pads of one side are offset from the contact pads of the other side.

Edge connector 10 includes an elongated dielectric housing, generally designated 12, which is fabricated of plastic material or the like. The housing has a plurality of depending mounting pegs 14 (FIG. 2) for insertion into appropriate mounting holes 16 in a second printed circuit board 18. This printed circuit board commonly is called the "mother" board, whereby edge connector 10 is effective to electrically couple circuitry of daughter board through its mating edge, with circuitry of mother board 18.

Still referring to FIGS. 1-3, elongated housing 12 of edge connector 10 is integrally molded of the dielectric material and includes a board-receiving slot means 20 for receiving the mating edge of the daughter board. The slot extends, as at 20*a* and 20*b*, outwardly and upwardly into a pair of upstanding post portions 22*a* and 22*b*, respectively, of the housing. Although not forming part of the invention, the connector includes an ejecting mechanism, generally designated 24, which is movable between the full-line position shown in FIG. 2 to an ejecting position, shown in phantom, in order to eject the daughter board from the connector, specifically from slot 20. The housing has a polarizing boss 25 which is offset from a mid-point of the elongated housing for engaging in a complementary polarizing recess in the mating edge of daughter board 11 and which also is similarly offset from a mid-point of the board.

Before proceeding further, it must be understood that such terms as "top", "bottom", "above", "below", and the like, are used in the specification herein and in the claims hereof not in a limiting sense but in order to more clearly define the invention, it being understood that edge connector 10 is totally omni-directional in use or application.

Figure 4:
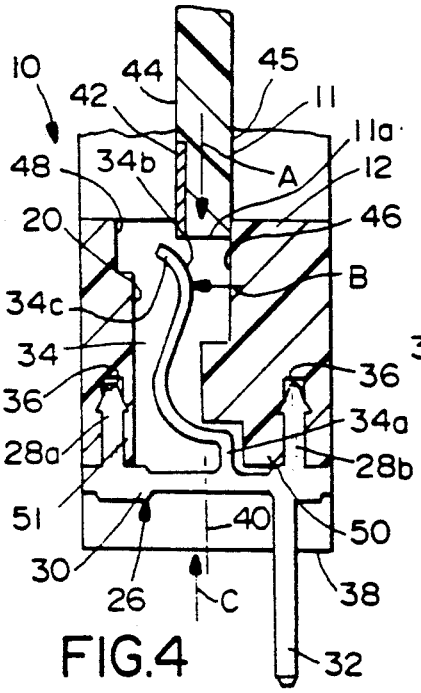
FIG. 4 is a section, on an enlarged scale, taken generally along the line 4—4 of FIG. 1.
Figure 5:
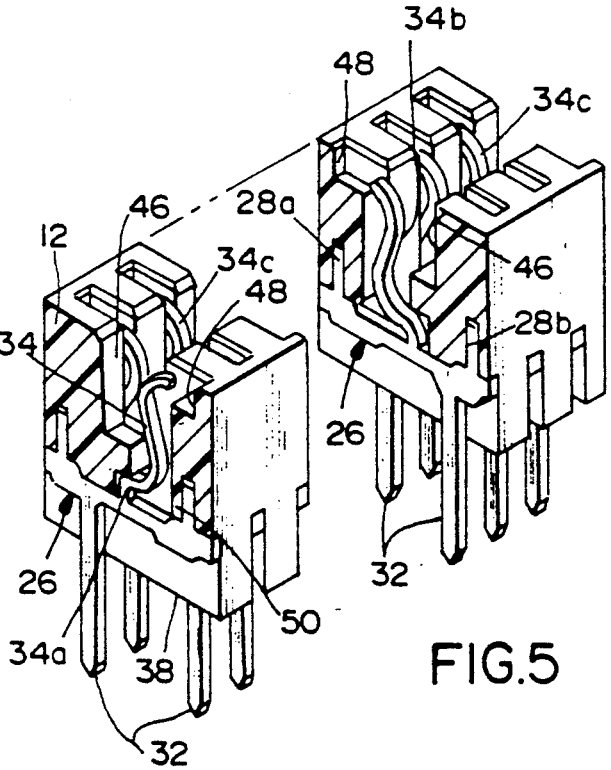
FIG. 5 is a fragmented perspective view of sections through the connector, as viewed generally in the direction of line 4—4 of FIG. 1.

Referring to FIGS. 4 and 5 in conjunction with FIGS. 1-3, a plurality of terminals, generally designated 26, are mounted on housing 12, generally within or about slot 20, and spaced longitudinally along the slot and housing for contacting daughter board 11 and terminating with mother board 18 in order to electrically interconnect the contact pads on the daughter board with the circuit traces on the mother board.

More particularly, each terminal 26 is edge blanked from sheet metal and includes a pair of side support portions 28*a* and 28*b*, a cross brace portion 30, a terminating portion 32, and a spring contact portion 34. Side support portions 28*a* and 28*b* are in the form of locking legs which project upwardly from opposite ends of cross brace portion 30. The legs are fixed to housing 12 within holes 36 in the housing outside of slot 20 in an interference fit. Cross brace portion 30 extends between the fixed legs. In the illustrated embodiment, terminating portion 32 is in the form of a solder tail for insertion into an appropriate hole in mother board 18 for interconnection to a circuit trace on the mother board or in the hole thereof, as by soldering. The terminating portions equally could be provided in the form of a surface mount foot which, like solder tail 32, would project from cross brace portion 30 at least below a bottom surface 38 of housing 12 for securement to a circuit trace on the mother board.

Lastly, spring contact portion 34 extends upwardly from cross brace portion 30 from one side of a mid-point 40 of the cross brace portion. The spring contact portion is curved, as at 34*a*, to provide a board contact area 34*b* offset to one side of mid-point 40 for engaging a contact pad 42 on one side 44 of daughter board 11. Mid-point 40 of cross brace portion 30 generally coincides with the mid-point of slot 20. The spring contact portion has an upper distal end 34*c* which is curved transversely for engaging a cut-out area 48 of housing 12 on the opposite side of slot 20 to provide an anti-overstress means for the spring contact portion. The terminals are "bottom loaded" into housing 12 in the direction of arrow "C" (FIG. 3).

The invention contemplates that housing 12 includes means for resisting the rotational moment of terminal 26 as daughter board 11 is inserted into slot 20 to bias spring contact portion 34 of the terminal transversely of the slot. More particularly, as seen best in FIG. 4, the housing includes portions or areas 50, 51 positioned at the top side of cross brace portion 30 at least at two locations spaced respectively on opposite sides of spring contact portion 34. In the illustrated embodiment, the supporting areas are provided by the housing immediately inside legs 28*a* and 28*b* which provide the side support portions for the terminal. Housing portion or area 50 resists rotational movement of the terminal as daughter board 11 is inserted into slot 20 in the direction of arrow "A". When so inserted, spring contact portion 34 is biased in the direction of arrow "B", resulting in an effective rotational moment of the terminal. Supporting area 50 of the housing resists this rotational moment by supportingly engaging the top side of cross brace portion 30. Therefore, stresses on any other portions or areas of the housing are relieved, at least in the immediate surrounding area of each terminal 26. In essence, supporting area 50 of the housing is put under compression and resists the rotational moments caused by the terminal being biased by insertion of daughter board against spring contact portion 34 of the terminal. Accordingly, it is understood that locking leg 28 could be eliminated.

The invention contemplates that the cooperative distribution of stresses afforded by the configuration of terminal 26 and the surrounding areas of housing 12, as described in relation to FIG. 4, be distributed lengthwise of the connector housing along slot 20 to further prevent distortion of the housing. More particularly, and with reference to FIG. 5, the invention contemplates that terminals 26 be oriented along slot 20 in an alternating array along the elongated housing. Therefore, it can be seen that the contact portions of the terminals, as alternatingly arrayed in FIG. 5, will be effective to alternatingly engage contact pads on opposite sides of daughter board 11. Consequently, the directions of the stresses between an individual terminal and the surrounding areas of the housing will alternate in opposite directions back-and-forth along the length of the housing, within the slot, as daughter board 11 biases the spring contact portions 34 of the terminals outwardly in alternating opposite directions.

Figure 6:
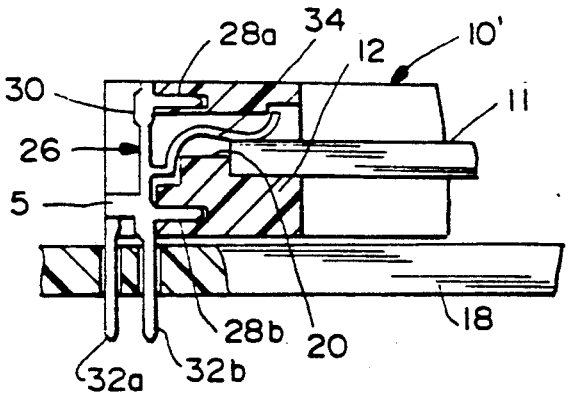
FIG. 6 is a sectional view through an alternate form of the invention wherein the terminals are angled to provide a right-angled connector.

FIG. 6 shows an alternate form of the invention wherein an edge connector, generally designated 10', is designed as a right-angled connector, with the terminals configured so that terminating portions or solder tails 32*a* and 32*b* of alternating terminals, respectively, project from the bottom of housing 12 generally transversely thereof. Each terminal includes a body portion 52 depending from cross brace portion 30, with the respective solder tails 32*a* and 32*b* projecting at right-angles to the body for insertion into appropriate holes in mother board 18. The terminals alternate lengthwise of the connector so as to have solder tails 32*a* at one end of the body portions 52 alternate with solder tails 32*b* at the opposite end of the body portions. Therefore, the solder tails are insertable into two rows of holes in printed circuit board 18 in an alternating manner. Otherwise, like numerals have been applied to like components in edge connector 10' corresponding to the components described above in relation to edge connector 10 (FIGS. 1–5) and the terminals thereof.

Figure 7:
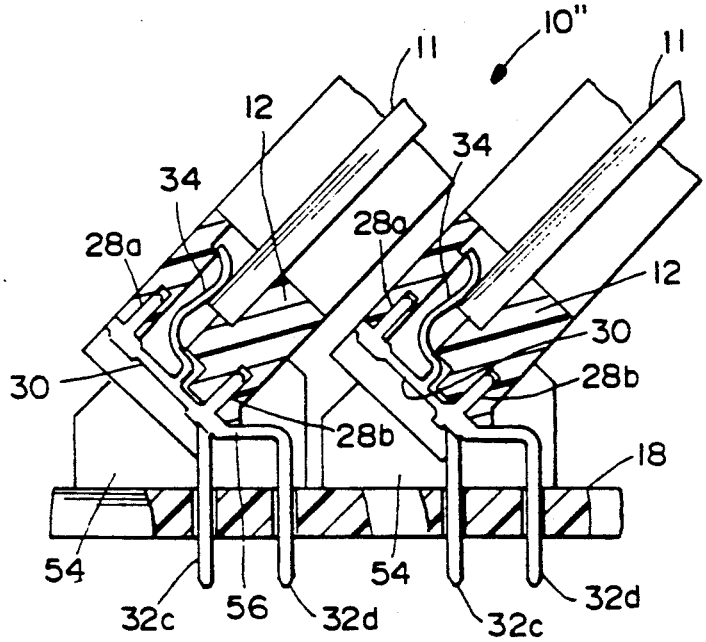
FIG. 7 is a sectional view of a further embodiment of the invention, incorporating two side-by-side connectors, with the terminals angled to provide an oblique configuration for the connector assembly.

FIG. 7 shows a further application of the invention wherein a pair of edge connectors 10'' are mounted in supports 54 whereby the connectors project from mother board 18 at an oblique angle thereto. In order to adapt the terminals of connectors 10'' for an oblique interconnection with two rows of circuit traces or holes on the printed circuit board, solder tails 32*c* and 32*d* project from cross brace portions 30 in an alternating array with alternating terminals. Specifically, solder tails 32*c* project from one end of their respective cross brace portions, and solder tails 32*d* have extension portions 56 to space solder tails 32*d* outwardly of the one end of the respective cross brace portions. Otherwise, just as with edge connector 10 (FIGS. 1–5), the spring contact portions 34 of alternating terminals lengthwise of the connector alternatingly engage contact pads on opposite side of daughter board 11 for each edge connector 10''. Again, the remaining portions of the terminals mounted within edge connectors 10'' are configured the same as terminals 26 in the embodiment of FIGS. 1–5 and cooperate with the housing to provide complementary supports to resist rotational movement of the terminals.

Figure 8:
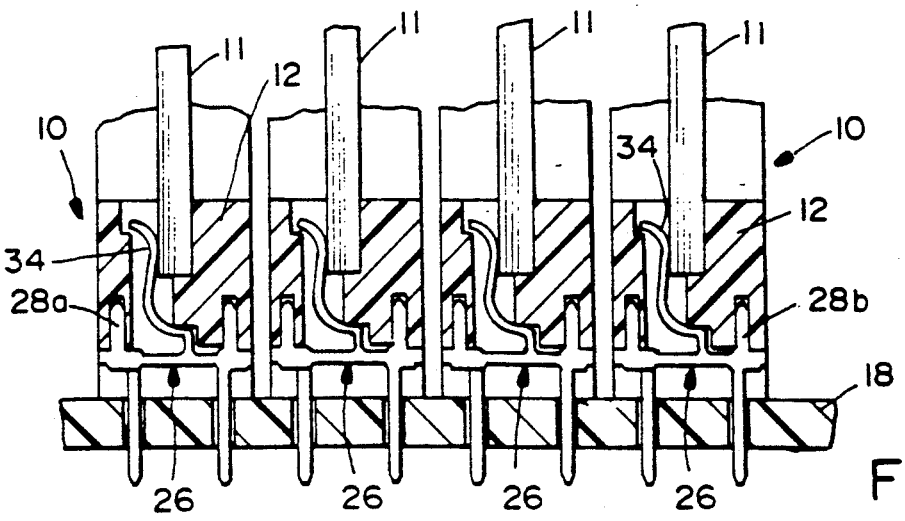
FIG. 8 is a sectional view showing an application of the invention wherein four connectors are mounted to a printed circuit board in a close side-by-side array.

Lastly, FIG. 8 simply shows four edge connectors 10 as described in relation to FIGS. 1–5 to exemplify that the connectors can be mounted to mother board 18 in a close side-by-side array of connectors. All of the embodiments of FIGS. 6–8 illustrate the versatility of the invention.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A push-pull edge connector for mounting to a mother board and for receiving an edge of a daughter board having a mating edge and a plurality of contact pads on opposite sides of the board adjacent the edge, said contact pads of each side being offset parallel to said edge with respect to the contact pads of the other side, said connector comprising:

an elongated dielectric housing including a board-receiving slot therein for receiving the mating edge of the daughter board, a pair of opposed side walls defining said board receiving slot, each said side wall having a lower surface generally perpendicular to said slot, a plurality of terminal receiving cavities evenly spaced along and in communication with said slot, said cavities extending upward from said lower surface to define first and second terminal stop surfaces in said opposed side walls on opposite sides of the board receiving slot, said first stop surface being substantially wider laterally of said board receiving slot than said second stop surface, said first and second terminal stop surfaces being oriented in an alternating array in said side walls along said slot;

a plurality of blanked terminals mounted on the housing in said cavities, each terminal including a side support portion fixed to said housing at said second stop surface, a spring contact arm having a contact portion for slidingly engaging one contact pad on only one side of the daughter board during insertion of a daughter board into said slot, a cross brace portion extending between the side support portion and the spring contact arm, and a terminating portion projecting from the cross brace portion for rigid securement to said mother board, said spring contact arm projecting from said cross brace portion at a point offset from the centerline of said slot, and said contact portion being offset to an opposite side of the centerline of said slot when a daughter board is inserted into said slot, whereby said contact portion and the intersection of said spring contact arm and said cross brace are on opposite sides of said centerline when a daughter board is inserted into said slot;

the terminals being oriented in an alternating array along the slot of the elongated housing so that the contact portions of the terminals alternatingly engage contact pads on opposite sides of a daughter board inserted into said slot; and wherein the first terminal stop surface supportingly engages the top side of the cross brace portion at a location on the opposite side of the centerline of the slot relative to the contact portion when a daughter board is inserted into said slot to resist rotational movement of the terminal resulting from the spring contact arm being biased transversely of the slot.

2. The edge connector of claim 1 further comprising a pair of side support portions positioned adjacent opposite ends of said cross brace portion, each being fixed to said housing at one of said terminal support surfaces by securement means; said securement means including a projecting leg slidingly received within an opening.

3. The edge connector of claim 1 wherein said terminating portion comprises a solder tail projecting from the cross brace portion below a bottom surface of the housing.

4. The edge connector of claim 1 wherein said spring contact arm includes an offset distal end for engaging a side of the slot in the direction of deflection of the spring contact arm upon insertion of a daughter board for providing an anti-overstress means for the spring contact arm.

5. A push-pull edge connector for receiving a printed circuit board having a mating edge and a plurality of contact pads on opposite sides of the board adjacent the edge, said contact pads of each side being offset with respect to the contact pads of the other side, said connector comprising:

an elongated dielectric housing having a board-receiving slot for receiving the mating edge of the printed circuit board;

a plurality of blanked terminals mounted on the housing seriatim along the slot, each terminal including means for securing said terminal to the housing, a cross brace portion extending across said slot, a tail portion projecting at least beyond a bottom surface of the housing for fixing to a complementary circuit component, and a spring contact arm projecting upwardly from the cross brace portion at a point offset from the centerline of said slot and including a contact portion for slidingly engaging one of the contact pads on only one side of the printed circuit board upon insertion of the board into the slot, said contact portion of said spring contact arm being offset to a side of said slot opposite said intersection of said spring contact arm and said cross brace when said board is inserted into said slot;

the terminals being oriented in an alternating array along the slot of the elongated housing whereby the contact portions of the terminals alternatingly engage contact pads on opposite sides of the printed circuit board.

6. The edge connector of claim 5 wherein the housing includes an enlarged portion supportingly engaging the top side of the cross brace portion at a side of the slot adjacent said intersection of spring contact arm and said cross brace to resist rotational movement of the terminal as the printed circuit board biases the spring contact arm transversely of the slot.

7. The edge connector of claim 5 wherein the housing includes an enlarged portion supportingly engaging the top side of the cross brace portion at a side of the slot adjacent said intersection of spring contact arm and said cross brace to resist rotational movement of the terminal as a printed circuit board inserted into said slot biases the spring contact arm transversely of the slot.

8. The edge connector of claim 5 wherein said means for securing said terminal to the housing includes a pair of locking legs located on opposite sides of the slot and extending from said cross brace.

9. The edge connector of claim 7 wherein said means for securing said terminal to the housing includes a pair of locking legs located on opposite sides of the slot.

10. The edge card connector of claim 9 wherein said enlarged portion of said housing is substantially larger than the portion of said housing engaging the portion of the cross brace on the opposite side of said slot.

11. The edge connector of claim 5 wherein said housing include first and second elongated side walls on opposite sides of the centerline of the slot and that define said slot, and said cross brace extends from the first side wall to the second side wall across said slot.

12. The edge connector of claim 11 wherein said securing means includes at least one locking member that engages a portion of the first side wall which is positioned to the side of the centerline of the slot opposite the intersection of said spring contact arm and said cross brace.

13. The edge connector of claim 12 wherein said second side wall is substantially wider laterally of the slot than said first side wall.

14. The edge connector of claim 13 wherein said securing means includes a first and second spaced apart locking members that extend from said cross brace, said first locking member engaging a portion of the first side wall and said second locking member engaging a portion of the second side wall.

15. A push-pull edge connector for mounting to a mother board and for receiving an edge of a daughter board having a mating edge and a plurality of contact pads on opposite sides of the board adjacent the edge, said contact pads of each side being offset parallel to said edge with respect to the contact pads of the other side, said connector comprising:

an elongated dielectric housing including a board-receiving slot therein for receiving the mating edge of the daughter board, a pair of opposed side walls defining said board receiving slot, each said side wall having a lower surface generally perpendicular to said slot, a plurality of terminal receiving cavities evenly spaced along and in communication with said slot, said cavities extending upward from said lower surface to define first and second terminal stop surfaces in said opposed side walls on opposite sides of the board receiving slot, said first stop surface being substantially wider laterally of said board receiving slot than said second stop surface, said first and second terminal stop surfaces being oriented in an alternating array in said side walls along said slot;

a plurality of blanked terminals mounted on the housing in said cavities, each terminal including a side support portion fixed to said housing at said second stop surface, a spring contact arm having a contact portion for slidingly engaging one contact pad on only one side of the daughter board during insertion of a daughter board into said slot, a cross brace portion extending between the side support portion and the spring contact arm, and a terminating portion projecting from the cross brace portion for rigid securement to said mother board, said spring contact arm extends upwardly from the cross brace portion generally at a point intermediate the ends thereof and the intersection of said contact arm and said cross brace being offset to one side of the centerline of the slot and said contact portion adapted to engage the contact pad of a printed circuit board positioned on the other side of the centerline of the slot;

the terminals being oriented in an alternating array along the slot of the elongated housing so that the contact portions of the terminals alternatingly engage contact pads on opposite sides of a daughter board inserted into said slot; and wherein the first terminal stop surface supportingly engages the top side of the cross brace portion at a location on the same side of the slot relative to the intersection of the spring contact arm and the cross brace to resist rotational movement of the terminal resulting from the insertion of a daughter board into the slot to bias the spring contact arm transversely of the slot.

16. The edge connector of claim 15 further comprising a pair of side support portions positioned adjacent opposite ends of said cross brace portion, each being fixed to said housing at one of said terminal support surfaces by securement means, said securement means including a projecting leg slidingly received within an opening.

* * * * *